United States Patent [19]

Annas

[11] Patent Number: 4,552,999

[45] Date of Patent: Nov. 12, 1985

[54] TIME DELAY SWITCH

[75] Inventor: Dulin L. Annas, Hickory, N.C.

[73] Assignee: Anteg, Inc., Hickory, N.C.

[21] Appl. No.: 633,358

[22] Filed: Jul. 23, 1984

[51] Int. Cl.[4] ..... H01H 43/00

[52] U.S. Cl. ..... 200/34; 200/82 C

[58] Field of Search ..... 200/82 C, 34, 61.41, 200/83 T, 186, 153 T, 332

[56] References Cited

U.S. PATENT DOCUMENTS 1,662,711 3/1928 Maynard ..... 200/34

3,187,121 6/1965 Mingrone ..... 200/34

*Primary Examiner*—A. D. Pellinen

*Assistant Examiner*—Morris Ginsburg

*Attorney, Agent, or Firm*—Roy B. Moffitt

[57] ABSTRACT

A time delay switch comprising a housing, an actuating device partially in and partially outside of the housing, a switch capable of being rendered to a first and a second state, biasing device and a compressible/expansional pneumatic device disposed in the housing for rendering the switch from a first to a second state; the actuating device is movable within the housing from a first to a second position from a portion of it outside of the housing; the switch is affixed to the actuating device; the biasing device is connected to the actuating device portion inside of the housing and to the housing itself so that the actuating device is biased towards its first position; and, the pneumatic device is aligned with the switch and compresses same causing the switch to be in its first state when the actuating device is in its first position and when the actuating device is in its second position and the pneumatic device is in its fully expanded state, the pneumatic device has a rate of expansion from its compressed to its expanded state less than the actuating device and can be operated, thereby creating a time interval between the compressed and expanded state whereby the switch is not in contact with the pneumatic device and is thus in its second state.

16 Claims, 7 Drawing Figures

TIME DELAY SWITCH

BACKGROUND OF THE INVENTION

In a number of industries, furniture being one of them, there has been and there is still a need for a time delay switch that is responsive to a physical act, such as pushing a piece of wood stock into a predetermined position to start a desired operation (a sawing or wood carving operation for example) and after a predetermined length of time (time for the operation to be finished) the sawing or wood carving mechanism is automatically de-energized and this de-energized state is maintained while the stock is withdrawn from the working area and the switch repositioned for a subsequent like operation. Only after another piece of stock is again inserted into the same predetermined position is the switch activated to repeat the operation. Accuracy and variability of the predetermined time of operation (or non-operation if desired) is highly desirable in such switch and the means that is used to fix and to change the "on" or "off" time interval should be reliable, rugged, easily adjustable and precise.

Repetitive actions, like that described above, require a switch that can be either stationary or mobile and one that can be "re-set" in preparation for a subsequent action after having been rendered to a predetermined state ("on" or "off") for a given time. Resetting must take place in response to the removal of the work stock from the place where it is being subjected to active work and while the switch itself is and is maintained in a predetermined (for example "off") state. It is towards the solution of these problems that the present invention is directed.

BRIEF DESCRIPTION OF THE INVENTION

The present invention is a time delay switch comprising a housing, an actuating means partially in and partially outside of the housing, a switch capable of being rendered to a first or a second state, biasing means and a compressible/expansional pneumatic means disposed in the housing for rendering the switch from a first to a second state. The actuating means is movable within the housing from a first to a second position from a portion of it outside of the housing. The switch is affixed to the actuating means and the biasing means is connected to the actuating means portion inside of the housing and to the housing itself so that the actuating means is biased towards its first position. The pneumatic means is aligned with the switch and compresses same against the pneumatic means causing the switch to be in its first state when (a) the actuating means is in its first position and when the pneumatic means is in its compressed state; and, (b) when the actuating means is in its second position and the pneumatic means is in its fully expanded state. The penumatic means has a variable rate of expansion from its compressed to its expanded state which is less than the rate of travel of the actuating means can be operated, thereby creating a time interval between the compressed and expanded state whereby the switch is not in contact with said pneumatic means and is thus in its second state.

Also included in the pneumatic means is a means for varying the rate of travel from the compressed to the expanded state and this means extends from the pneumatic means inside of the housing to a position on the outside, thereby permitting easy access and permitting an operator a means to adjust the time the switch is to be in its second state.

DETAILED DESCRIPTION OF THE INVENTION

Figure 1:
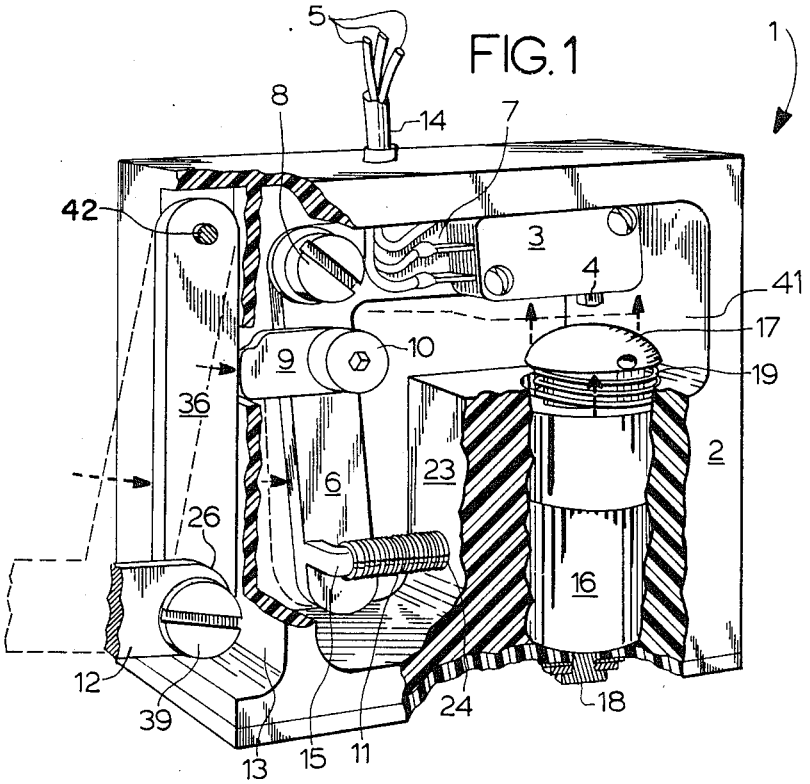
FIG. 1 is a cutaway plan view of one embodiment of the invention.

Elements 1 and 35 (FIGS. 1 and 2 respectively) identify first and second embodiments of the present invention. According to FIG. 1 and element 1, housing 2 having sidewalls 41 is shown containing a pneumatic means 16, switch 3 and an "L" shaped actuating means made up of elements 6, 7 and 8, pivotally mounted arm 9, bar 36 and outside member 12. Also included in the housing is biasing means 11, normally a spring.

Figure 7:
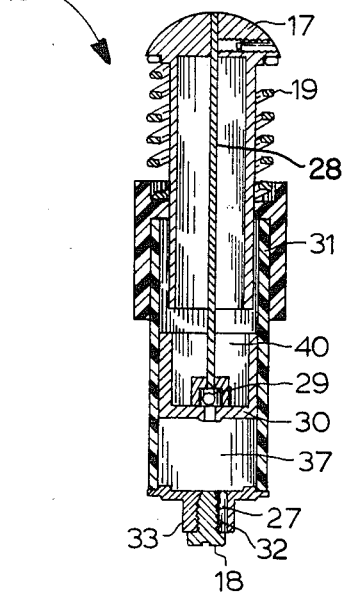
FIG. 7 is a cross sectional front elevation view of an exemplary pneumatic means.

Referring briefly to the pneumatic means 16 as shown in FIG. 7, such device is one that is known in the prior art and can be purchased from the Airpot Corporation of 27 Lois Street, Newark, Conn. 06851 sold underneath the trademark "Airpot." It is composed of a housing 31 which is a precision bore-ultra low friction cylinder in which there is disposed a connecting rod 28 connected to a selectively matched graphite carbon piston 30. The connecting rod is connected to ball joint 29. On one terminal free edge of cylinder 31 is an infinitely adjustable orifice 32, in which there is disposed a mounting stud 33 in which there is disposed screw 18. The space to the left of screw 18 creates vent path 27 through which air may flow into the cylinder 37 to allow the connecting rod to travel upwardly by means of spring 19. Attached to spring 19 is head 17 which is adapted to connect with, depress and release activating switch member 4, as will be hereinafter described. Piston 30 creates two chambers in housing 31, see elements 37 and 40, chamber 37 is in communication with the air outside by means of vent 27. The operation of pneumatic means 16 is believed to be evident from its physical makeup. When element 17 is compressed against spring 19, air is forced out of chamber 37 through vent 27 and spring 19 is compressed. When the compressive forces are released, air from the outside flows through vent path 27 into chamber 37 thereby allowing the force of spring 19 to force head member 17 in the bias direction of the spring. Obviously, the rate of travel of connecting rod 28, spring 19 and head member 17 is a function of the size of vent path 27, which controls the rate of flow of air from the outside into chamber 37.

The rate of air transfer is determined by the diametric clearance between piston 30 and cylinder wall 31 and by the vent 27 setting. As piston 30 moves in response to an exerted force, there will be a change in volume and pressure in pneumatic means 16, causing ambient air to enter or leave cylinder 37. By simple adjustment of vent 27, the rate of air flow is controlled to provide an exact degree of head 17 rate of travel. See U.S. Pat. No. 3,175,646.

Returning now to element 1 of FIG. 1, pneumatic means 16 is shown disposed in the right-hand side of the housing interior, with adjusting means 18 (screw) disposed on the outside of the housing, so that the rate of flow of air into chamber 37 can be controlled from the outside and thereby control the rate of travel of connecting rod 28, spring 19 and head 17, the importance of which will be hereinafter described.

Switch 3 is affixed to arm 7. At the juncture where arms 6 and 7 meet there is affixing means 8 which pivotally attaches arms 6 and 7 to housing 2. Electrically connected to switch 3 are conductor means 5 which are circumscribed by in jacket 14 in a manner well known to the art. Switch 3 can be of any variety, capable of a first and second state, e.g., "on" or "off." Depending on the desired function, depression of activating means 4 can either turn the switch 3 on or it can turn the switch 3 off.

An actuating means is shown made up of the "L" shaped member (arms 6 and 7), arm 9, bar 36 and outside means 12. Outside means 12 is pivotally attached to bar 36 and bar 36, at its extreme lefthand terminal portion, is pivotally attached by pin 42 to housing 2. Bar 36 is adapted to abut against arm 9, which is pivotally attached to arm 6 of the "L" shaped means. To a terminal portion of arm 6 is fixed stud 15 onto which is threaded spring 11 and this spring is of such a length that it abuts against housing shoulder 23 at point 24. On the outside of housing 2 is outside means 12, which has a terminal free edge 26 adapted to abut against shoulder 13, thereby limiting its travel and thus the inwardly travel of bar 36, arms 9 and 6 and 7. Effectively, shoulder 13 is a stop means that delimits the inward travel path of outside means 12 and the balance of the activating means attached or abutting thereto or therewith.

Switch 3 of FIG. 1 is shown in the second position, e.g., the "on" position. For the sake of description only, the fully extended position of activating means 4 of switch 3 will be hereinafter used and defined as the second state and the fully depressed condition of activating means 4 of switch 3 being the first state, "on" and "off" positions respectively. It is to be realized, however, that the use of the terms "first" and "second" positions is arbitrary and such usage can mean either "on" or "off" relating to the electrical condition of switch 3, depending on the ultimate use of the switch.

Figure 2:
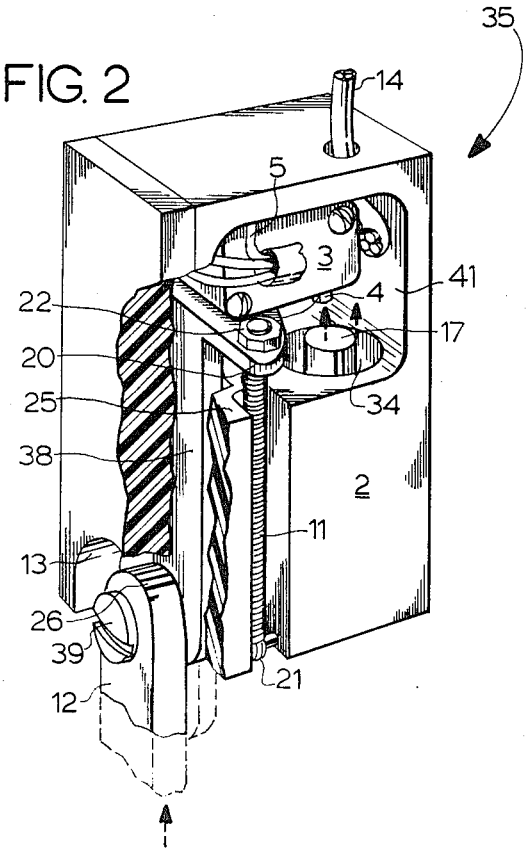
FIG. 2 is a cutaway plan view of another embodiment of the invention.

Referring now to FIG. 2, shown by element 35 is another embodiment of the present invention. This embodiment also has a housing 2 including sidewall 41, in which there is disposed biasing means 11 (usually a spring) terminated at one end to the housing by element 21 (a screw) and on its other end to stop means 20 by bolt 22. Stop means 20 is an integral part of arm 38, which performs a function like arm 6 and 7 of the embodiment 1. Stop means 20 is adapted to abut against a shoulder 25, which delimits its outward travel path from its fully extended to its fully bias state, which will be described hereafter. Switch 3, having activating means 4, is attached to stop means 20 and contains the usual electrical conductors 5 circumscribed by a jacket 14. Switch 3 of FIG. 2 operates in the same way as switch 3 in FIG. 1. Disposed in cavity 34 is a pneumatic means 16 (not fully shown) having a head portion 17. It is constructed in the same manner as element 16 of FIG. 1, except that head 17 is cylinder-like rather than "mushroom" shaped.

Disposed on the outside of housing 2 is outside means 12, attached to actuating means 38 by bolt means 39. Outside means 12 contains a terminal free edge 39 which is adapted to abut against shoulder 13 of the housing thereby delimiting the inwardly travel path of outside means 12 and actuating means 38.

Figure 3:
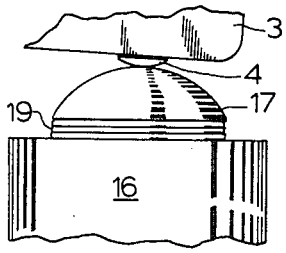
FIGS. 3 and 4 are fragmentary exploded views of the relative positions of pneumatic means 16 and switch 3 of FIGS. 1 and 2 when the pneumatic means 16 is in its fully compressed state.
Figure 4:
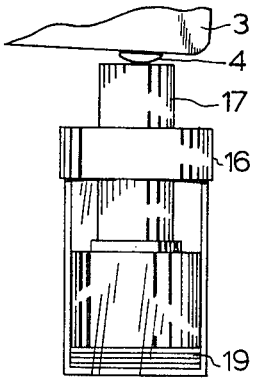

Turning now to FIGS. 3 and 4, there is shown in these figures switch 3 and activating means 4, in contact with a head 17 of pneumatic means 16, with the spring 19 of the pneumatic means 16 fully compressed. The only difference between elements of FIGS. 3 and 4 is that head 17 of FIG. 3 is "mushroom shaped" (the head 17 of FIG. 4 is cylindrically shaped) and the placement of spring 19. It will be noted that when the pneumatic means 16 is fully compressed, activating means 4 of switch 3 is fully depressed, thereby rendering switch 3 in its first state (e.g., off), which may be either on or off depending on its desired operation or non-operation. A fully compressed state of pneumatic means 16 (shown in FIGS. 3 and 4) is the normal state of the switch; i.e., when there is no pressure or force acting upon outside means 12. When biasing means 11 of element 35 of FIG. 2, is in its fullest expanded state or as with the case of element 1 of FIG. 1 it is in its compressed state, actuating means 38 of FIG. 2 the "L" shaped arm of FIG. 1 (arms 6 and 7) along with arm 9 and bar 36, extend outside means 12 to a position so that it is spaced apart from shoulder 13.

Figure 5:
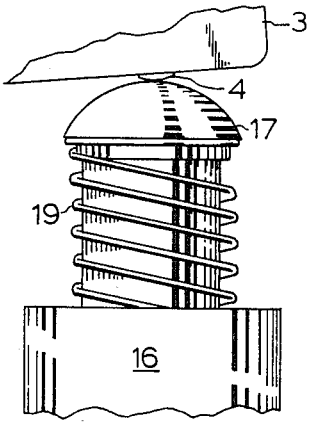
FIGS. 5 and 6 are fragmentary exploded views of the relative positions of pneumatic means 16 and switch 3 of FIGS. 1 and 2 when the pneumatic means 16 is in its fully expanded state.
Figure 6:
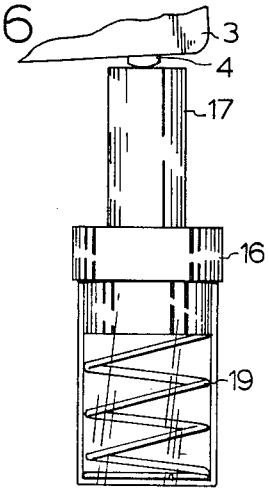

Referring to FIGS. 5 and 6, the same elements are shown here as in FIGS. 3 and 4, respectively, the only difference there between being that the pneumatic means 16 in FIGS. 5 and 6 is in its fully extended state, rather than its fully compressed state as was the case in FIGS. 3 and 4. In this state, biasing means 11 of element 1 is compressed, biasing means 11 of element 35 is expanded and outside means 12 in both embodiments abuts against shoulder 13. It will be noted that actuating means 4 of switch 3 in FIGS. 5 and 6 are in the same position (first state) when the pneumatic means is in its fully extended state as was the case when the pneumatic means was in its fully compressed state. Compare FIGS. 3 and 4 with FIGS. 5 and 6.

With respect to the aforementioned description of pneumatic means 16, switch 3 and activating means 4 as per FIGS. 3, 4, 5 and 6, a comparison of the state of these elements with like elements of FIGS. 1 and 2 is in order. In FIG. 1, switch 3 and activating means 4 are in the second state and while they are in such second state, it will be noted that the pneumatic means 16 (specifically head 17) is in transition from the fully compressed state as shown in FIGS. 3 and 4 to the ultimately fully extended state (shown in FIGS. 5 and 6). For example, in FIG. 2, activating means or arm 38 can be moved inwardly by outside means 12 from its position where element 12 is spaced apart from shoulder 13 and stop 20 abuts against shoulder 25 to where element 12 abuts against shoulder means 13. In other words, means 38 has moved from its fully biased position to its fully depressed inward position. The rate of travel of acuating means 38 and switch 3 attached thereto, from the fully biased position (stop means 20 abutting against shoulder 25) to the fully inwardly extended position (stop 26 abutting shoulder 13) is greater than the rate of travel of head 17 from its compressed state (FIGS. 3 and 4) to its fully extended state (FIGS. 5 and 6) and thus reaches its fully extended state prior to head 17 coming in contact with activating means 4 of switch 3 and rendering it to the second position or state as shown by FIGS. 5 and 6.

The time interval it takes head 17 of pneumatic means 16 to travel from its fully compressed (see FIGS. 4 and 5) to its fully extended (FIGS. 5 and 6) position is that time interval during which switch 3 is in its second state. The rate of travel of head 17, as previously described, is a function of the amount of air going through vent path 27 through orifice 32 into chamber 37 and is variably controlled by screwing screw 18 member inwardly or outwardly so as to increase or decrease the rate of air inflow to lengthen or shorten the time interval it takes head 17 to travel from its fully compressed to its fully extended state, namely, the state as shown by FIG. 4 through the state as shown by FIG. 6.

Switch 1 of FIG. 1 works on the same principle as that described for element 35 of FIG. 2, the only difference between embodiments 1 and 35 being the "L" shaped arm (elements 6 and 7) baising means 11, bar 9 pivotally attached to element 6, bar 36 abutting against arm 9, outside means 12 pivotally attached to bar 36 and the position of spring 19 on pneumatic means 16. Elements 12, 36, 9, 6 and 7 of FIG. 1 perform the same function relative to the switch and the pneumatic means as elements 12 and 38 perform for the embodiment 35 of FIG. 2. Inward movement of outside means 12 (its free edge or surface 26 is spaced apart from shoulder 13 in its normal position) pushes against arm 9, which pushes or causes "L" shaped arms 6 and 7 to rotate to the left (counterclockwise) thereby compressing biasing means 11 and removing switch 3 and activating means 4 from contact with head 17 of pneumatic means 16. Upon release of inward pressure of means 12 the reverse takes place.

As was described for FIG. 2, the rate of travel of penumatic means 16 from its fully compressed (FIG. 3) to its fully extended (FIG. 5) position determines the time interval that switch 3 in its second state. By rotating screw means 18, this time interval can be increased or decreased as desired by increasing the vent path space through which air can inflow into chamber 37. The dotted lines of FIG. 1, both for the pneumatic means 16 and elements 12, 36, 9, 6 and 7 depict the bias position that these elements would be in in its normal state and the solid lines indicate the position that these elements would be in once inward force has been applied to number 12 sufficient to overcome the biasing means.

Operation of the embodiments shown by elements 1 and 35 in FIGS. 1 and 2 are as follows: For the sake of simplicity the structure of element 35 of FIG. 2 will be used; however, it should be kept in mind that elements 12 and 38 of FIG. 2 have the same function relative to the movement of switch 3 and the compression of pneumatic means 16 (head 17) as elements 12, 36, 9, 6 and 7 of element 1 of FIG. 1. The normal state of switch 3, activating means 4 and pneumatic means 16 are as shown by FIG. 4 with elements 38 and 12 are in their fully bias state; i.e., outside means free edge 26 is spaced apart from shoulder 13. Switch 3 in its first state; also, stop means 20 is in abutment with shoulder means 25. On depression of element 12, it moves until its free edge or surface 26 is in abutment with shoulder 13. The relative position of switch means 3 and its activating means 4, visa via the pneumatic means 16 is thus rendered to that instantaneous state as shown in FIG. 2, element 35, this state showing activating means 4 of switch 3 spaced apart from and not in contact with head 17. In such a state, switch 3 is in its second state.

Once the relative positions of switch 3 and activating means 4 and head 17 are rendered from that state shown in FIG. 4 to the position shown in FIG. 2, head 17 begins a controlled and much slower rate of travel (slower than the rate of travel) than elements 12 and 38. It travels towards its final position (FIG. 6) and its rate of travel being a function of and dependent upon air from the outside of pneumatic means 16 flowing through vent path 27 into chamber 37, thereby allowing spring means 19 to push head 17 towards activating means 4 of switch 3, while outside air flows into chamber 37. Once head 17 comes in contact with and depresses activating means 4, switch 3 goes from its second to its first state, as shown by FIG. 6. When the inward force (see the inwardly denoted dotted arrow) on element 12 is relieved, biasing means 11 forces arm 36—in the case of FIG. 1 arms 6, 7, 9 and member 36—to return to its normal state. During this return, it will be noted that activating means 4 of switch 3 is still depressed because it is still in contact with element 17. As a result of this contact, switch 3 remains in its first and normal state during the "resetting" or return of switch 3 and pneumatic means 16 to that state shown in FIGS. 3 and 5 respectively for embodiments of FIGS. 1 and 2.

In view of the above description, it can be readily seen that a work piece abutted against element 12 and inwardly thrusted causes switch 3 to go from a first to a second state. During this second state, an operation (or non-operation for that matter) can take place and that operation or non-operation is terminated after a predetermined length of time, namely after head 17 depresses activating means 4 of switch 3 thereby rendering switch 3 act to its initial and first state. When the work piece is removed from contact with element 12, the switch is "reset", i.e., the actuating means (elements 12 and 38 in case of FIG. 2) and (elements 12, 36, 9, 6 and 7 in the case of FIG. 1) will return to its normal state; namely, free edge or surface 26 is spaced apart from shoulder 13. During such return, activating means 4 of switch 3 is depressed because it is in contact with head 17. This resetting causes the switch to be in a state to undergo further repetitive operations.

What is claimed is:

1. A time delay switch comprising a housing containing actuating means, a biasing means, a switch means and a pneumatic means wherein:

(a) a part of the actuating means is disposed outside and a part inside of the housing and is movable from a first to a second position by the part located outside of the housing;

(b) the biasing means is attached to that part of the actuating means located inside of the housing and to the housing to bias the actuating means towards the first position;

(c) the switch means is in a first state when in contact with the penumatic means and a second state when not in contact with the pneumatic means; and, (d) the penumatic means is aligned with the switch means adapted to be in compressed, intermediate and expanded states and when in its compressed and expanded states it is in contact with the switch means and when in its intermediate state it is not in contact with the switch means.

2. The time delay switch of claim 1 containing a first and second stop means, said first stop means attached to that part of the actuating means in said housing for delimiting the movement of said actuating means in response to said biasing means, said second stop means attached to the part of said actuating means outside of the housing for abutting against said housing to limit the inward movement of said actuating means.

3. The time delay switch of claim 2 wherein the expanded state of said pneumatic means occurs when said second stop means is abutting against said housing.

4. The time delay switch of claim 2 wherein the compressed state of said pneumatic means occurs when said first stop means is abutting against the outside of said housing.

5. The time delay switch of claim 1 wherein said actuating means is adapted to be moved from the first position to the second position faster than the pneumatic means can move from the compressed to its expanded state.

6. The time delay switch of claim 1 wherein the part of the actuating means in said housing is an "L" shaped means having first and second legs.

7. The time delay switch of claim 6 wherein said switch means is attached to the first leg of said "L" shaped means.

8. The time delay switch of claim 7 wherein said biasing means is attached to the second leg of said "L" shaped means.

9. The time delay switch of claim 1 wherein said actuating means comprises first, second and third portions, said first portion being pivotably mounted on said housing and at least a part thereof disposed external thereto, said second portion abuts against said first portion, is movable into and out of said housing, is pivotably attached to said third portion and said third portion is "L" shaped having first and second legs.

10. The time delay switch of claim 9 wherein said biasing means is attached to the second leg of said "L" shaped portion.

11. The time delay switch of claim 9 wherein said switch means is attached to the first leg of said "L" shaped portion.

12. The time delay switch of claim 9 wherein said actuating means is adapted to be moved from the first position to the second position faster than the pneumatic means can move from the compressed to its expanded state.

13. The time delay switch of claim 1 wherein said pneumatic means is composed of a piston housing, a shaft, head means, a piston slideably disposed in a piston housing and a spring, said piston attached to the shaft, said shaft attached to said head means and said spring disposed between said head means and said piston housing biasing said head means away from said piston housing.

14. The time delay switch of claim 13, wherein the piston forms first and second chambers in said piston housing, a variable valve in the piston housing communicating with said first chamber and the air outside of the pneumatic means.

15. The time delay switch of claim 9 wherein said pneumatic means is composed of a piston housing, a head means, a shaft, a piston slideably disposed in the piston housing and a spring, said piston attached to the shaft and said shaft attached to said head means and said spring disposed between said head means and said piston housing biasing said head means away from said piston housing.

16. The time delay switch of claim 15 wherein the piston forms first and second chambers in said piston housing, a variable valve in the piston housing communicating with said first chamber and the air outside of the pneumatic means.

* * * * *